US005996257A

United States Patent [19]

Harrison

[11] Patent Number: 5,996,257

[45] **Date of Patent: *Dec. 7, 1999**

[54] PUNCTURE-RESISTANT AND IMPACT-RESISTANT SAFETY SHOE INSERT

[75] Inventor: Frederick A. Harrison, Kitchener, Canada

[73] Assignee: William H. Kaufman Inc., Kitchener, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/078,508

[22] Filed: May 14, 1998

[51] Int. Cl.[6] ..... A43B 13/22; A43C 13/14

[52] U.S. Cl. ..... 36/72 R; 36/75 R; 36/77 R; 36/30 R; 36/107

[58] Field of Search ..... 36/72 R, 76 C, 36/72 A, 73, 75 R, 77 R, 107, 108, 43, 44, 30 R

[56] References Cited

U.S. PATENT DOCUMENTS

| | | | |
|---|---|---|---|
| 42,187 | 4/1864 | Griswold . | |
| 252,626 | 1/1882 | Schenck . | |
| 634,361 | 10/1899 | Marlow . | |
| 1,685,538 | 9/1928 | Glidden et al. | 36/30 R |
| 1,829,612 | 10/1931 | Sato . | |
| 2,229,387 | 1/1941 | Parker | 36/30 R |
| 2,348,300 | 5/1944 | Klaus | 36/44 |
| 2,803,895 | 8/1957 | Frieder et al. | 36/73 |
| 4,231,170 | 11/1980 | Griswold | 36/72 R |
| 4,706,316 | 11/1987 | Tanzi | 36/77 R |
| 4,888,888 | 12/1989 | Ashton . | |
| 4,908,963 | 3/1990 | Krajcir et al. | 36/72 R |
| 5,003,709 | 4/1991 | Okayasu et al. | 36/107 |
| 5,285,583 | 2/1994 | Aleven | 36/44 |
| 5,546,680 | 8/1996 | Barma et al. . | |

*Primary Examiner*—M. D. Patterson
*Attorney, Agent, or Firm*—Ridout & Maybee

[57] ABSTRACT

A protective safety shoe insert includes a seamless puncture-resistant insole substantially conforming in shape to a sole of the shoe. The insole comprises a flexible steel plate coinciding with an area of greatest flexure of the insole and a layer of a puncture-resistant material secured to the ends of the plate. The insole is injection molded with an integral safety toe, an integral arch support, and an optional integral heel protector. A metatarsal guard is secured to the safety toe to add impact protection for the metatarsal area of the foot.

16 Claims, 6 Drawing Sheets

PUNCTURE-RESISTANT AND IMPACT-RESISTANT SAFETY SHOE INSERT

FIELD OF THE INVENTION

This invention relates to a lightweight protective insert for safety footwear. Specifically, this invention relates to a molded plastic insert which provides puncture protection for the bottom of the foot and impact protection for the toes and metatarsal region of the foot.

BACKGROUND OF THE INVENTION

Conventional safety boots and safety shoes are comprised of a puncture-resistant insole which provides protection against sharp objects injuring the bottom of the foot, and a separate safety toe which provides impact protection for the toes.

The conventional puncture-resistant insole typically comprises a semi-rigid stainless steel plate, approximately 0.5 mm thick. However, due to the difficulty of bonding the stainless steel plate to the safety boot or safety shoe, the plate is usually incorporated into an insole assembly or a midsole assembly. Since the steel plate in such assemblies must be smaller than the insole of the shoe, the conventional puncture-resistant insole does not provide full protection for the underside of the foot. In addition, as the steel plate extends over a large area of the entire insole/midsole assembly, safety footwear fabricated with steel plates are excessively heavy and insufficiently flexible to allow the wearer to walk comfortably.

The conventional safety toe is typically fabricated from hardened steel. Although such safety toes provide adequate impact protection for the toes, they are excessively heavy and suffer from the disadvantage that they are perceived to contribute to cold feet. Furthermore, as steel is difficult to bond to, it has been difficult to secure the safety toe to the puncture-resistant insole in a manner which provides seamless protection for the toes and the underside of the foot.

U.S. Pat. No. 5,285,583 to Aleven teaches a safety insole which attempts to overcome some of these deficiencies. Aleven teaches a safety insole comprising a high impact-resistant plastic injection layer injection molded between an upper liner and lower insole board. Prior to injection molding, a stainless steel plate is inserted between the liner and the insole board at the forepart of the insole. The impact-resistant plastic layer is then injected molded between the liner and the insole board. The plastic layer overlaps the top and bottom faces of the plate and is anchored to the plastic layer through locking holes located at the rear margin of the plate.

The protective insole taught by Aleven is light in weight since a substantial portion of the steel plate in the conventional protective insole is replaced with lightweight plastic. However, numerous deficiencies are inherent in the Aleven insole. First, as the plastic only bonds with the rear margin of the stainless steel plate, the resulting flex zone may be too narrow to allow the wearer to walk comfortably. Second, as flexing is localized over a very narrow zone, at the region of greatest flexure, the bond between the plastic and the steel plate may separate prematurely, thereby exposing the bottom of the foot to the possibility of injury from sharp objects. Finally, Aleven teaches nothing about providing seamless protection for the toes and the underside of the foot.

Accordingly, there remains a need for a comfortable protective insert which is lightweight and durable, and which offers seamless protection for the toes and the underside of the foot.

SUMMARY OF THE INVENTION

According to the invention, there is provided a protective seamless puncture-resistant insert for insertion into a safety shoe and which is simple and inexpensive to manufacture and provides puncture protection over a greater area of the bottom of the foot than conventional protective insoles. In addition, the insert is more durable than conventional protective inserts but is also more flexible around the ball of the foot to provide greater comfort to the wearer than conventional protective inserts.

The protective insert according to the invention includes a seamless puncture-resistant insole substantially conforming in shape to the sole of the safety shoe. The insole comprises a flexible puncture-resistant plate coinciding with an area of greatest flexure of the insole and including a pair of opposite ends and a first surface extending between the opposite ends; and a layer of a puncture-resistant material secured to the plate adjacent each of the opposite ends.

The protective insert includes a safety toe, an arch support, and an optional heel protector integrally molded with the insole to provide seamless protection for the toes, the arch, the heel, and the underside of the foot.

BRIEF DESCRIPTION OF THE DRAWINGS

The preferred embodiment of the invention will now be described with reference to the drawings, in which like reference numerals represent like elements, and in which.

DESCRIPTION OF THE PREFERRED EMBODIMENT

Figure 1:
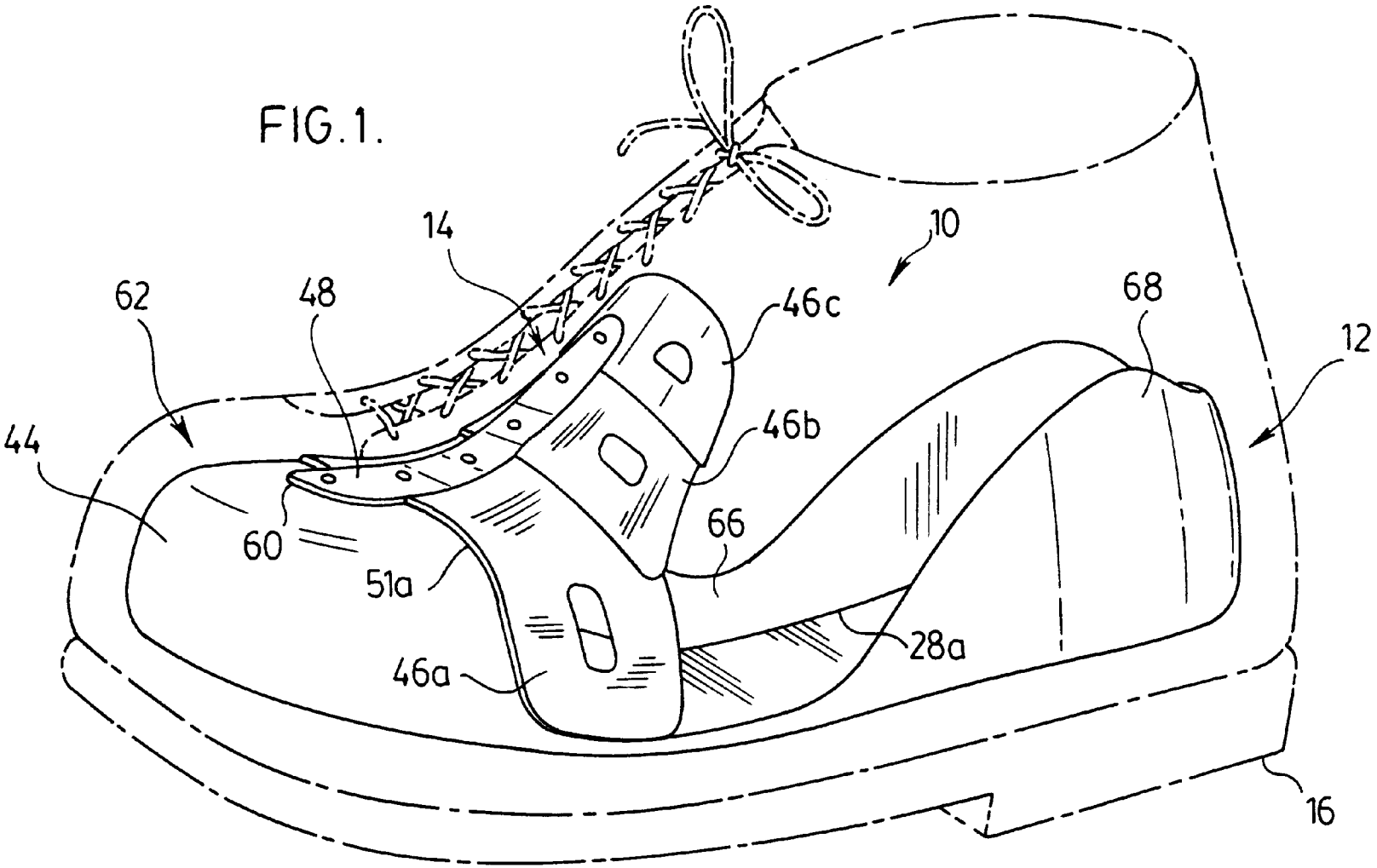
FIG. 1 is a perspective view of the protective insert according to the invention, shown inserted into a boot.
Figure 2:
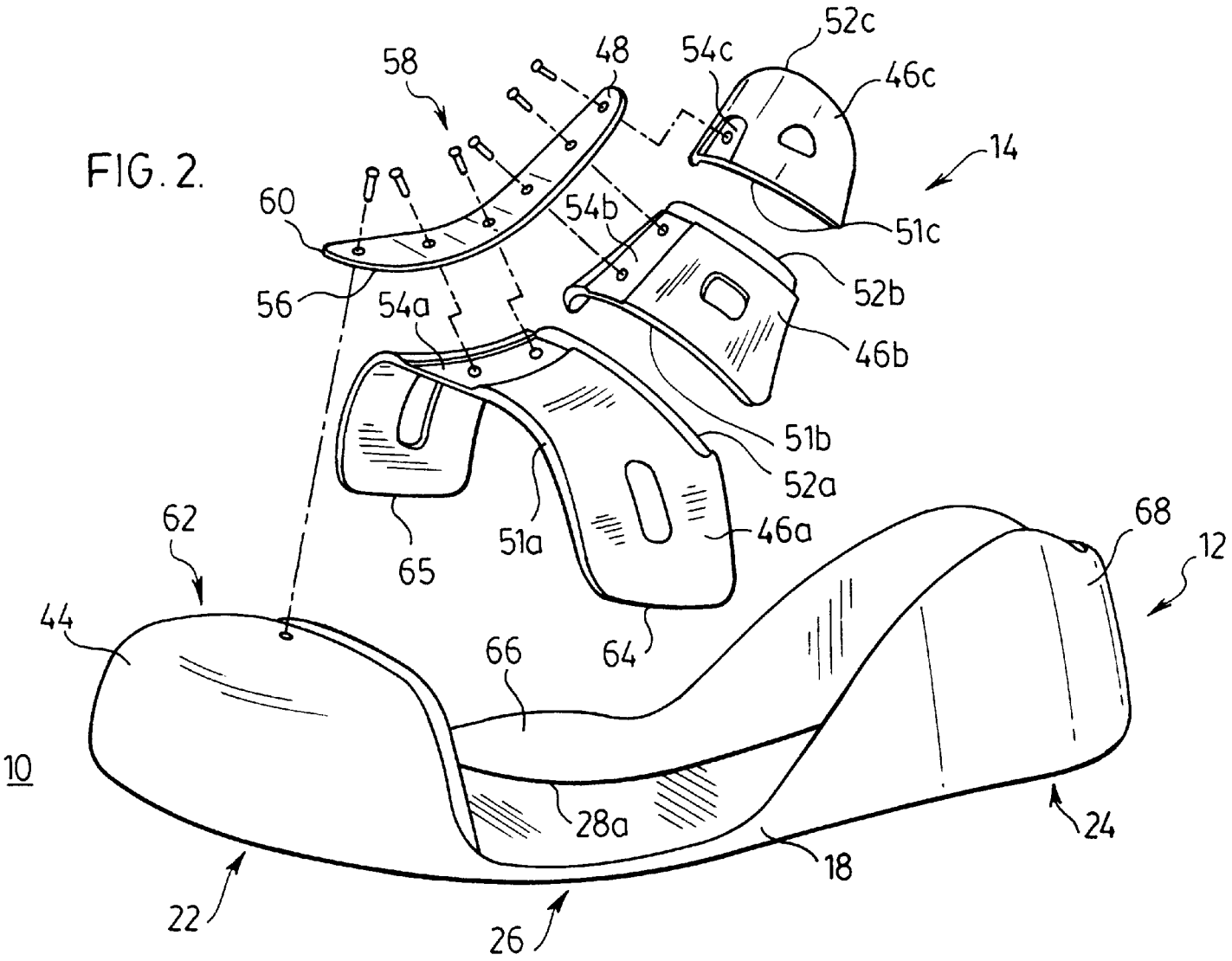
FIG. 2 is an exploded view of the protective insert showing the puncture-resistant insole, the safety toe, the arch support, the heel protector, and the metatarsal guard.

Referring to FIGS. 1 and 2, a protective insert, denoted generally as 10, is shown comprising an insole 12 and a metatarsal guard 14 inserted into a boot 16 (FIG. 1). The insole 12 comprises a layer 18 of injection-moldable puncture-resistant and impact-resistant plastic material, and a thin metal plate 20 (FIGS. 3 and 4) bonded to the plastic layer 18. However, it should be understood that the reference herein to plastic material and a metal plate should not be considered as limiting. These materials are merely examples of suitable materials and those skilled in the art will be able to make substitutes therefor without departing from the spirit or scope of the invention as claimed.

Figure 3:
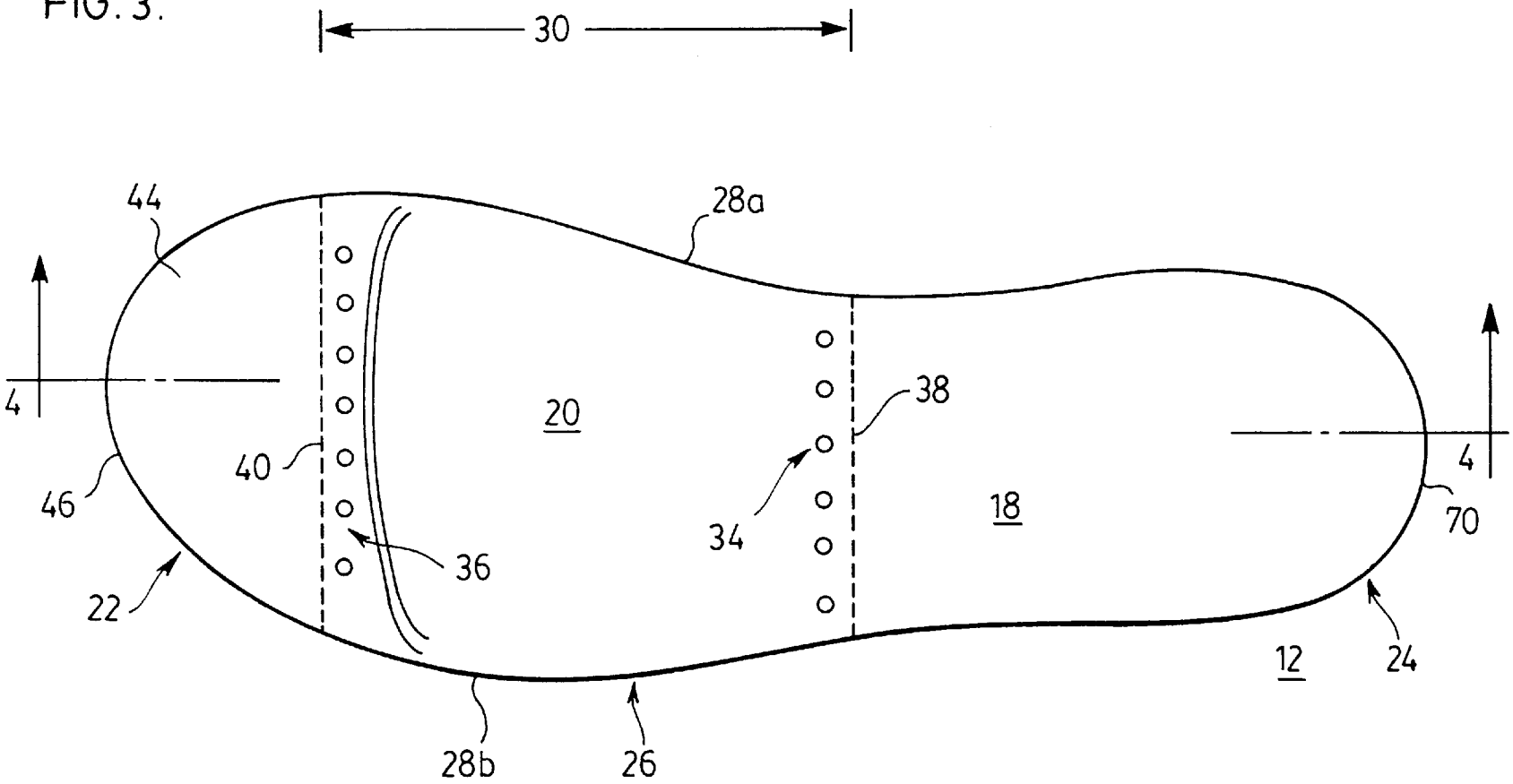
FIG. 3 is a top plan view of the protective insert, showing the safety toe and the flexible steel plate.

Turning to FIG. 3, the insole 12 is shown substantially conforming in shape to the sole area of the boot 16. As a result, the insole 12 provides seamless puncture protection over substantially the entire sole area of the boot 16. Furthermore, as the insole 12 is fabricated from plastic, the weight of the insole 12 is less than that of conventional safety (or protective) insoles, and allows the insole 12 to be more readily secured to the boot 16 than conventional insoles.

Figure 4:
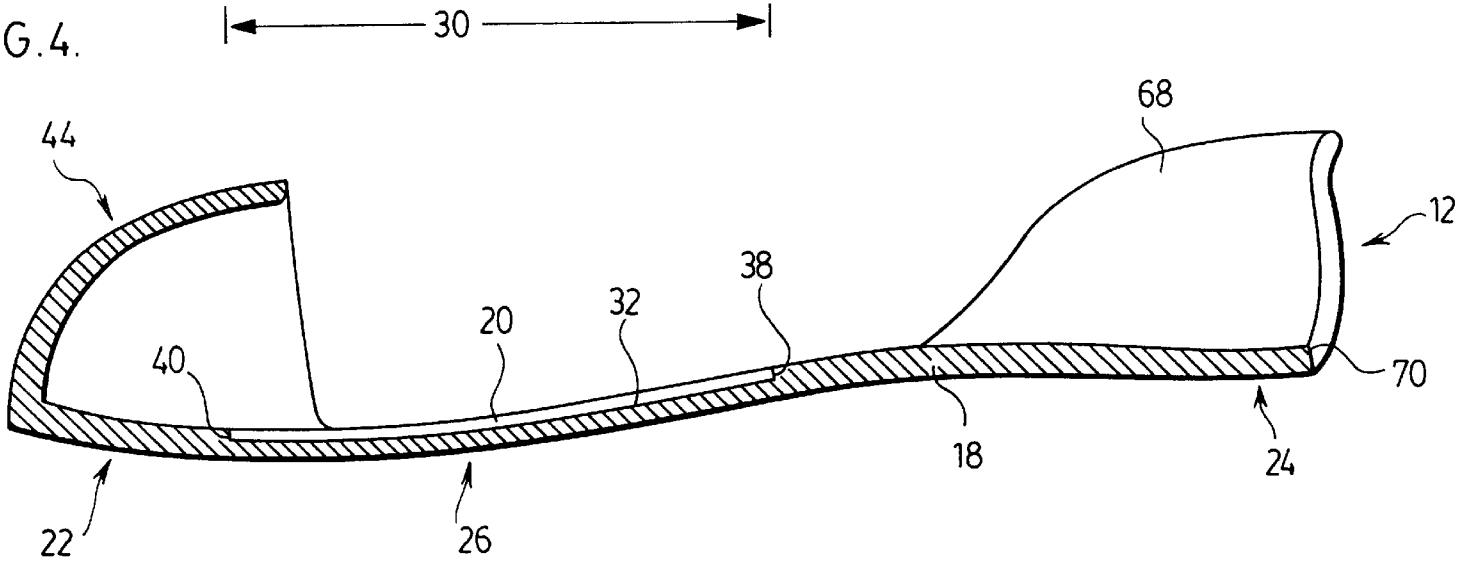
FIG. 4 is a cross-sectional view of the protective insert taken along the line 4—4 of FIG. 3.

Turning to FIG. 4, the insole 12 is shown including a toe section 22, a heel section 24, and a forepart section 26 extending between and integrally molded with the toe section 22 and the heel section 24. The forepart section 26 coincides with the area of greatest flexure of the boot 16. In addition, the thickness of the plastic layer 18 in the forepart section 26 is less than that in the toe section 22 and the heel section 24. The thin plate 20, which is flexible along substantially its entire length, is bonded to the forepart section 26 during an injection molding step, described below. As shown in FIG. 3, the side edges of the plate 20 respectively coincide with the inside edge 28*a* and outside edge 28*b* of the insole 12 in the forepart section 26.

The plate 20 effectively serves three purposes. Firstly, the plate 20 increases the level of puncture protection in the forepart section 26 to a level commensurate with that in the toe section 22 and the heel section 24. Secondly, since the side edges of the plate 20 respectively coincide with the inside edge 28*a* and the outside edge 28*b* of the insole 12, the insole 12 provides seamless puncture protection over substantially the entire sole area of the foot. Lastly, as the plate 20 is flexible along substantially the entire length thereof, the plate 20, in conjunction with the reduced thickness of plastic layer 18 in the forepart section 26, defines a flex zone 30 in the forepart section 26. The flex zone 30 extends the length of the plate 20 and thereby increases the flexibility of the insole 12 in the forepart section 26. Since the forepart section 26, and hence the plate 20, coincide with the area of greatest flexure of the boot 16, the invention allows the wearer of the boot 16 to walk more comfortably than with convention protective insoles but without sacrificing puncture protection in the area of greatest flexure.

Figure 5:
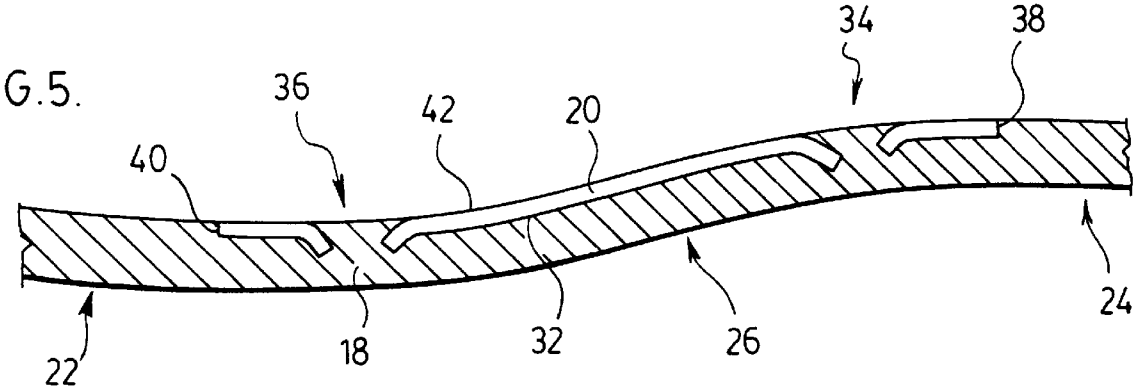
FIGS. 5–8 are cross-sectional views of the protective insert according to various aspects of the invention.

Still referring to FIG. 4, the plate 20 is shown secured to the plastic layer 18 by injection molding the forepart section 26 of the plastic layer 18 to substantially the entire lower surface 32 of the plate 20. To facilitate adhesion between the forepart section 26 of the plastic layer 18 and the plate 20, and to prevent lateral and longitudinal movement of the plate 20 with respect to the plastic layer 18 in the forepart section 26, the plate 20, as shown in FIGS. 3 and 5, includes a plurality of holes 34, 36 adjacent the respective opposite ends 38, 40 of the plate 20 extending between the upper surface 42 and the lower surface 32. As will be appreciated, the plastic material enters the holes 34, 36 during injection molding and thereby secures the ends 38, 40 of the plate 20 to the plastic layer 18.

Figure 6:
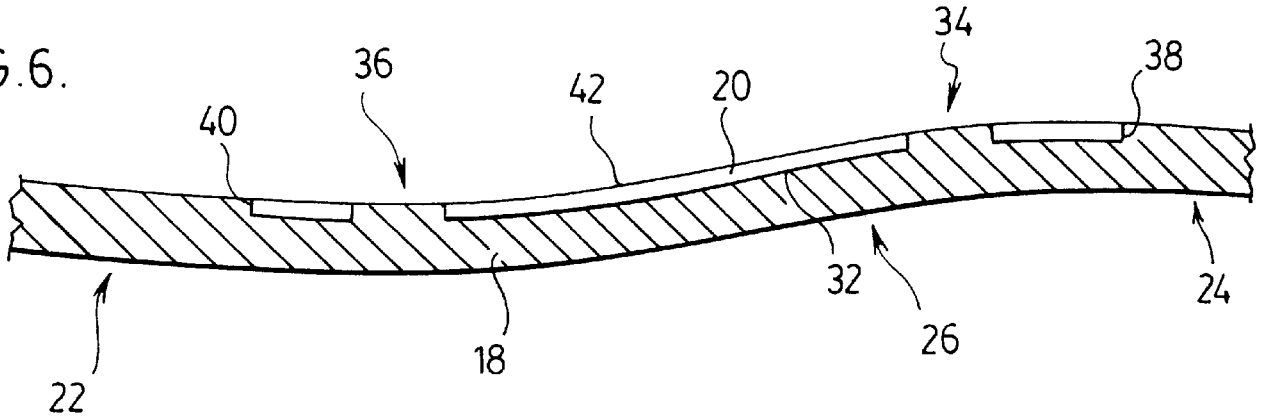

As shown in FIG. 5, the diameter of the holes 34, 36 at the upper surface 42 of the plate 20 is greater than that at the lower surface 32 to provide maximal adhesion between the ends 38, 40 of the plate 20 and the plastic layer 18. However, in one variation, shown in FIG. 6, the holes 34, 36 are of uniform diameter.

Turning to FIGS. 3 and 4, the insole 12 is shown including an injection molded plastic safety toe 44 which adds impact protection for the toes. The safety toe 44 extends upwards and rearwards from the front perimeter 46 (FIG. 3) of the toe section 22, and is injection molded with the same puncture-resistant and impact-resistant plastic material with which the toe section 22, forepart section 26, and heel section 24 of the plastic layer 18 is fabricated. Additionally, the safety toe 44 is integrally molded with the toe section 22, the forepart section 26, and the heel section 24 in a single injection molding step. As a result, the insole 12 provides seamless impact and puncture protection for the toes and the sole of the foot.

Turning again to FIG. 2, the metatarsal guard 14 is shown secured to the safety toe 44 to provide impact protection for the metatarsal area of the foot. The metatarsal guard 14 comprises a series of progressively smaller arched rigid plastic members 46 (shown individually as 46*a*, 46*b*, 46*c*) and a curved elongate flexible plastic support strip 48. Each arched member 46 has a pair of opposite side edges 51, 52 (shown individually as 51*a*, 52*a*, 51*b*, 52*b*, 51*c*, 52*c*). The uppermost portion of each arched member 46 includes a recessed section 54 (shown individually as 54*a*, 54*b*, 54*c*) for receiving a respective part of the bottom surface 56 of the support strip 48.

The metatarsal guard 14 is assembled by placing the arched members 46 side by side, such that the side edge 52*a* of arched member 46*a* is adjacent the side edge 51*b* of arched member 46*b* and the side edge 52*b* of arched member 46*b* is adjacent the side edge 51*c* of arched member 46*c*. The arched members 46 are joined at their respective recessed sections 54 to the bottom surface 56 of the support strip 48 through fasteners 58. As shown in FIG. 1, the side edge 51*a* of the metatarsal guard 14 is positioned slightly rearward of the safety toe 44. The bottom surface 56 of the support strip 48 adjacent the free end 60 thereof is joined to the uppermost portion 62 of the safety toe 44 through a fastener 58.

In order that the metatarsal guard 14 does not limit the flexibility of the flex zone 30, the bottom ends 64, 65 of the arched member 46a extend down to the plastic layer 18 in the forepart section 26 but do not engage the plastic layer 18. However, the support strip 48 is sufficiently flexible so that when a downward force is applied to the metatarsal guard 14, the bottom ends 64, 65 engage the plastic layer 18 in the forepart section 26 and protect the metatarsal area of the foot.

Still referring to FIG. 2, the insole 12 is shown including an injection molded plastic arch support 66 which adds support and puncture protection for the arch of the foot. The arch support 66 extends upwards from the plastic layer 18 along a portion of the inside edge 28*a* of the insole 12 adjacent the forepart section 26 and the heel section 24. The arch support 66 is injection molded with the same puncture-resistant and impact-resistant plastic material with which the toe section 22, forepart section 26, and heel section 24 of the plastic layer 18 is fabricated. As with the safety toe 44, the arch support 66 is integrally molded with the toe section 22, the forepart section 26, and the heel section 24 in a single injection molding step.

In one variation of the invention, shown in FIGS. 1, 2 and 4, the heel section 24 includes an injection molded plastic heel protector 68 which adds specific puncture protection for the heel. The heel protector 68 extends upwards from the rear perimeter 70 (FIG. 4) of the heel section 24 and surrounds the heel of the foot. The heel protector 68 is injection molded with the same puncture-resistant and impact-resistant plastic material with which the toe section 22, forepart section 26, and heel section 24 of the plastic layer 18 is fabricated. In addition, the heel protector 68 is integrally molded with the toe section 22, the forepart section 26, and the heel section 24 in a single injection molding step. As a result, the insole 12 provides seamless protection against sharp objects entering the heel section 24 at any angle with respect to the bottom of the boot 16.

A method of manufacturing the insert 10 will now be described with reference to FIGS. 3 and 5. The plate 20 is inserted into a mold (not shown) which is adapted to create an integrally molded safety toe 44, arch support 66 and heel protector 68. An injection-moldable puncture-resistant and impact-resistant plastic material is then injected into the mold. The plastic material bonds to the lower surface 32 of the plate 20, and also enters the holes 34, 36 and becomes keyed to the plate 20 to prevent lateral and longitudinal movement of the plate 20 with respect to the forepart section 26 of the plastic layer 18.

In a preferred embodiment of the invention, the plate 20 is a substantially planar stainless steel metal plate, approximately 0.5 mm thick and 5 cm long. The thickness of the plastic layer 18 in the toe section 22 and in the heel section 24 is approximately 4 mm, and the thickness of the plastic layer 18 in the forepart section 26 is approximately 0.5 mm. Upon removal of the insert 10 from the mold after injection molding, the metatarsal guard 14 is secured to the insert 10 in the manner described above. The resulting insert 10 provides a flex zone 30, approximately 5 cm long, extending substantially the entire length of the plate 20. The insert 10 is then inserted into a boot 16 and secured therein by means known to those skilled in the art.

Figure 7:
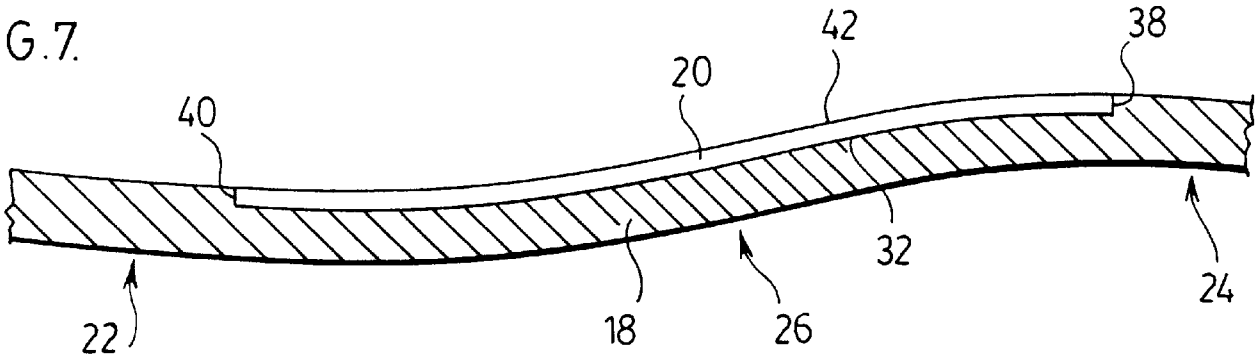
Figure 8:
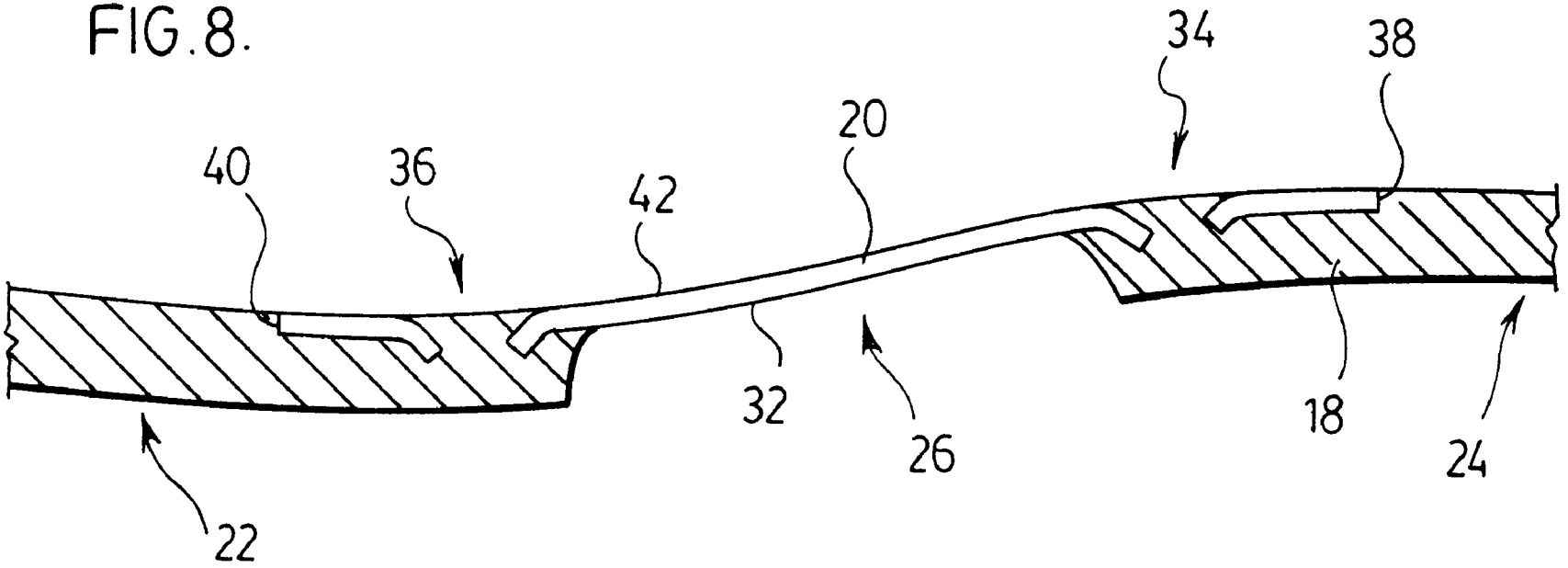

In one variation of the preferred embodiment, the plate 20 is replaced with a series of reinforcing ribs (not shown). In another variation, shown in FIG. 7, the holes 34, 36 in the plate 20 are eliminated and the plastic layer 18 in the forepart section 26 is bonded to the plate 20 along substantially the entire lower surface 32 of the plate 20. In yet another variation, shown in FIG. 8, the plastic layer 18 in the forepart section 26 is eliminated altogether and the ends 38, 40 of the plate 20 are respectively secured to the plastic layer 18 in the toe section 22 and in the heel section 24 through the holes 34, 36.

The description of the preferred embodiments is intended to be illustrative, rather than exhaustive, of the present invention. Those persons of ordinary skill will be able to make certain additions, deletions, and/or modifications to the embodiments disclosed without departing from the spirit or scope of the invention, as defined by the appended claims.

We claim:

1. A protective insert for insertion into footwear and including a seamless puncture-resistant insole substantially conforming in shape to a sole of the footwear, the insole comprising:

a flexible puncture-resistant, unitary metal plate coinciding with an area of greatest flexure of the insole and including a pair of opposite ends and a first surface and a second surface extending between the opposite ends, said second surface being opposite the first surface, with a plurality of holes adjacent each end extending between the first and second surfaces; and a layer of a puncture-resistant material secured to the plate adjacent each of the opposite ends, said layer comprising an injection-moldable puncture-resistant plastic material injection molded to the plate adjacent each of the opposite ends;

wherein said insole has a smooth, uninterrupted first surface which is coincident with the second surface of the metal plate over substantially the entire area of the insole between the opposite ends of the metal plate other than at the holes through the metal plate, with the remainder of the first surface of the insole being coincident with a surface of said layer of puncture-resistant plastic material.

2. A protective insert according to claim 1, wherein the insert includes a safety toe comprising an injection-moldable puncture-resistant and impact-resistant plastic material integrally molded with a front portion of the insole.

3. A protective insert according to claim 2, wherein the insert includes a metatarsal guard coupled to the safety toe.

4. A protective insert according to claim 1, wherein the insert includes a heel protector comprising the plastic material integrally molded with a rear portion of the insole.

5. A protective insert according to claim 1, wherein the insole includes an arch support comprising the plastic material integrally molded with a middle portion of the insole.

6. A protective insert according to claim 1, wherein the insole includes an inside edge and an outside edge, the plate includes a pair of opposite side edges extending between the opposite ends, and the inside and outside edges coincide with a respective opposite side edge.

7. A protective insert according to claim 1, wherein the layer is injection molded to the plate along substantially all of the first surface.

8. A protective insert according to claim 1, wherein the plate comprises a substantially planar stainless steel metal plate.

9. A safety shoe comprising:

a shoe including a sole having an area of greatest flexure; and a protective insert secured inside the shoe and including a seamless puncture-resistant insole substantially conforming in shape to a sole of the shoe, the protective insole comprising:

a flexible puncture-resistant unitary metal plate coinciding with the area of greatest flexure and including a pair of opposite ends and a first surface and a second surface extending between the opposite ends, said second surface being opposite the first surface, with a plurality of holes adjacent each end extending between the first and second surfaces; and a layer of a puncture-resistant material secured to the plate adjacent each of the opposite ends, said layer comprising an injection-moldable puncture-resistant plastic material injection molded to the plate adjacent each of the opposite ends;

wherein said insole has a smooth, uninterrupted first surface which is coincident with the second surface of the metal plate over substantially the entire area of the insole between the opposite ends of the metal plate other than at the holes through the metal plate, with the remainder of the first surface of the insole being coincident with a surface of said layer of puncture-resistant plastic material.

10. A safety shoe according to claim 9, wherein the protective insert includes a safety toe comprising an injection-moldable puncture-resistant and impact-resistant plastic material integrally molded with a front portion of the insole.

11. A safety shoe according to claim 10, wherein the protective insert includes a metatarsal guard coupled to the safety toe.

12. A safety shoe according to claim 9, wherein the protective insert includes a heel protector comprising the plastic material integrally molded with a rear portion of the insole.

13. A safety shoe according to claim 9, wherein the insole includes an arch support comprising the plastic material integrally molded with a middle portion of the insole.

14. A safety shoe according to claim 9, wherein the insole includes an inside edge and an outside edge, the plate includes a pair of opposite side edges extending between the opposite ends, and the inside and outside edges coincide with a respective opposite side edge.

15. A safety shoe according to claim 9, wherein the layer is injection molded to the plate along substantially all of the first surface.

16. A safety shoe according to claim 9, wherein the plate comprises a substantially planar stainless steel metal plate.

* * * * *